United States Patent [19]

Chraplyvy et al.

[11] 4,312,684

[45] Jan. 26, 1982

[54] SELECTIVE MAGNETIZATION OF MANGANESE-ALUMINUM ALLOYS

[75] Inventors: Andrew R. Chraplyvy, Troy, Mich.; John J. Croat, Sterling Height; Jan F. Herbst, Warren, all of Mich.

[73] Assignee: General Motors Corporation, Detroit, Mich.

[21] Appl. No.: 138,239

[22] Filed: Apr. 7, 1980

[51] Int. Cl.[3] ..... H01F 1/00

[52] U.S. Cl. ..... 148/121; 148/101; 148/31.55; 148/31.57

[58] Field of Search ..... 70/413; 365/10, 11; 340/543; 148/101, 102, 103, 31.57, 31.55, 108, 120, 121; 75/134 M

[56] References Cited

U.S. PATENT DOCUMENTS

| | | | |
|---|---|---|---|
| 2,869,111 | 1/1959 | Young | 340/166 FE |
| 3,116,181 | 12/1963 | Hokkeling et al. | 148/31.57 |
| 3,212,546 | 10/1965 | Lind | 335/303 |
| 3,661,567 | 5/1972 | Yamamoto | 75/134 M |
| 3,676,867 | 7/1972 | Bacon et al. | 148/31.57 |
| 3,730,784 | 5/1973 | Yamamoto | 148/31.57 |
| 3,953,252 | 4/1976 | Levin et al. | 148/121 |
| 3,998,669 | 12/1976 | Strnat | 148/31.57 |
| 4,007,073 | 2/1977 | Levin et al. | 148/120 |
| 4,042,429 | 8/1977 | Kojima et al. | 148/120 |

OTHER PUBLICATIONS

Hoch et al., "New Material for Permanent Magnets on a Base of Mn and Al", Reprinted from Journal of Applied Physics Supplement, vol. 31, No. 5, 75S–77S, May 1960.

*Primary Examiner*—L. Dewayne Rutledge
*Assistant Examiner*—John P. Sheehan
*Attorney, Agent, or Firm*—E. F. Harasek

[57] ABSTRACT

A portion of a nonmagnetic body of manganese-aluminum based alloy is tempered in situ to a state of high magnetic coercivity. The magnetically coercive portion may be used, e.g., to store magnetically readable information or to provide a tailored permanent magnetic field for an electrical device.

8 Claims, 3 Drawing Figures

SELECTIVE MAGNETIZATION OF MANGANESE-ALUMINUM ALLOYS

BACKGROUND OF THE INVENTION

This invention relates to the treatment of a body of manganese-aluminum alloy that is initially nonmagnetic wherein a selected portion is selectively treated to form regions of high intrinsic magnetic coercivity.

Alloys of aluminum and about 65–75 weight percent manganese that are rapidly cooled from a temperature above about 1100° C. to about 400° C. transform to a nonmagnetic phase. The microstructure of such nonmagnetic alloys of manganese-alluminum is substantially orthorhombic. Tempering at a suitable temperature above about 450° C. substantially converts the orthorhombic alloys to a different crystal structure that is ferromagnetic, and has high coercivity. An alloy tempered in this manner has a relatively high magnetic saturation of about 7000 Gauss and uniaxial magnetic anisotropy. Magnets with energy products as high as 7.0 megaGauss-Oersteds have been prepared from compositions of about 70 weight percent manganese, 30 weight percent aluminum, and less than 1 weight percent carbon, the carbon acting to stabilize the magnetic manganese-aluminum phase. Such magnets are approximately 40 percent stronger per unit weight than typical ferrite magnets. The manganese-aluminum alloys also have high mechanical strength compared to magnetic aluminum-nickel-cobalt or ferrite alloys, and the raw materials are relatively inexpensive.

There are applications where it is desirable to magnetize only a selected region of a nonmagnetic manganese-aluminum alloy body. For example, an ordered array of dots or lines, readily readable by a conventional electronic pickup could be used to permanently, invisibly, and indelibly mark articles for identification purposes. Larger manganese-aluminum bodies, such as arcuate pole pieces for cylindrically-shaped DC motors, could be selectively magnetized to tailor magnetic flux fields for maximum device performance. Selected microscopic portions of, e.g., of thin layer of a nonmagnetic manganese-aluminum alloy, could be selectively magnetized to serve as permanent read-only-memory (ROM) for a microprocessor or other computer device.

OBJECTS OF THE INVENTION

It is an object of this invention to provide an article comprising a nonmagnetic alloy based on aluminum and about 65–75 weight percent manganese, wherein a selected portion of the alloy is tempered in situ to a magnetically coercive state. It is a more particular object to provide a manganese-aluminum based alloy that is initially in a nonmagnetic state but wherein a portion is selectively magnetized and has a relatively high magnetic coercivity. It is a more specific object to provide a manganese-aluminum based alloy having a nonmagnetic orthorhombic microstructure wherein an integral heat-tempered portion has hard ferromagnetic characteristics and a substantially different crystal structure.

It is another object of the invention to induce magnetism in a selected portion of a nonmagnetic manganese-aluminum based alloy by selectively heating such portion with focused radiation. It is also an object to create magnetically readable information in a nonmagnetic manganese-aluminum based alloy in the form of regions of high magnetic coercivity. Another object is to write magnetically readable information on a nonmagnetic alloy of manganese and aluminum by means of laser or other focused radiation. A more specific object is to write magnetically readable information by a heat-induced transition from a nonmagnetic crystal structure to a magnetic crystal structure in a manganese-aluminum based alloy.

BRIEF SUMMARY OF THE INVENTION

In accordance with a preferred practice of the invention, an alloy of aluminum and about 65–75 weight percent manganese which has been rapidly cooled (approximately 30° C./sec) from about 1100° C. to about 400° C. is provided. Magnetism cannot be induced in such alloy by an applied magnetic field (i.e., it is nonmagnetic), and it has a substantially orthorhombic crystal structure. A workpiece of desired configuration is positioned in a suitable holder. A source of radiation capable of transmitting energy to the alloy is focused on that portion of the workpiece to be magnetized. A preferred radiation source is a low-wattage argon laser. Radiation exposure is continued until the magnetic transition temperature of the alloy is reached. The transition temperature is the temperature at which the substantially orthorhombic crystal structure is transformed to a different, magnetically coercive structure believed to be body-centered tetragonal. For the orthorhombic manganese-aluminum system (not containing other elements such as carbon or nickel), the transition temperature is above about 450° C., but below about 600° C. The workpiece is allowed to cool, and is exposed to an external magnetic field of suitable strength and polarity to induce the desired residual coercivity selectively in the heated, transformed portion.

The surface area and depth of the magnetically coercive portion is a function of the area of the beam spot of the focused radiation. For example, a 2 watt laser beam focused to a beam spot a few millimeters wide can heat the surface portions of a workpiece to temperatures of about 1500° C. With such concentrated radiation directed at the surface, heating is rapid enough to minimize the effects of heat transfer to adjacent unradiated areas. Thus, the invention provides for sharp definition between the treated and magnetically coercive portion and nonmagnetic untreated portion of a manganese-aluminum alloy body. This capability makes the invention particularly suitable for permanently storing great quantities of information in magnetically readable form in relatively small areas.

DETAILED DESCRIPTION OF THE INVENTION

Our invention will be better understood in view of the following Figures, detailed description, and examples. In the Figures.

Figure 1:
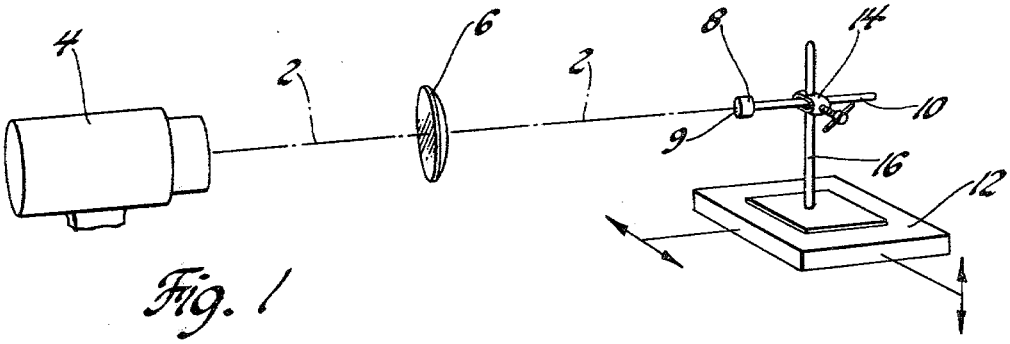
FIG. 1 is a schematic representation of an apparatus for tempering a selected portion of a manganese-aluminum workpiece by heating it with laser radiation.

Alloys of aluminum and 65–75 weight percent manganese, when rapidly cooled from a temperature above about 1100° C. to a temperature below about 400° C., form a substantially orthorhombic phase. This phase is nonmagnetic. Tempering at a suitable elevated temperature above 400° C. transforms the orthorhombic phase to a ferromagnetic phase which is believed to be body-centered tetragonal. The transformation temperature for Mn-Al alloys without other elements is in the range of from about 450°-600° C. Small amounts (generally less than one weight percent) of elements such as carbon or nickel may be added to manganese-aluminum alloys to stabilize the magnetic crystal structure. The presence of such elements also tends to elevate the temperature range for magnetic transformation. For example, the transformation temperature for a suitable manganese-aluminum alloy with 0.5 weight percent added carbon is about 500°-700° C. Other elements which do not interfere with the thermal transition of the alloys from a nonmagnetic to a magnetic state may be incorporated in amounts of up to about 10% by weight. This body centered tetragonal phase of a Mn-Al system generally has a magnetic saturation of up to 7000 Gauss and high uniaxial anisotropy along the crystallographic C-axis. It has a coervicity of above about 1000 Oersteds, qualifying it as a permanent magnet material.

A suitable alloy for this invention may be formed by casting an ingot of about 65-75 weight percent manganese, 25-35 weight percent aluminum in an induction furnace. The cast ingot is preferably annealed at a temperature above about 1100° C. and rapidly quenched to below 400° C. The ingot thus produced is nonmagnetic with a substantially metastable orthorhombic crystal structure. The assay of the alloy ingots from which the samples of the following Examples were taken was approximately: 70.4 weight percent manganese; 28.9 weight percent aluminum; 0.5 weight percent carbon; and 0.2 weight percent nickel.

By "tempering" herein is meant the process of heating a substantially nonmagnetic alloy to a temperature such that its crystalline microstructure is transformed to a substantially different microstructure that is magnetically coercive. Tempering may be performed by means of focused radiation from a laser. While a laser is a preferred heating means, other radiation sources such as electron beam, molecular beams, etc., may be employed. Our invention will be better understood in view of the following specific examples.

EXAMPLE 1

Twenty-one (21) roughly wafer-shaped samples about 3.5 mm in diameter and 0.1 mm thick were sliced from ingots of the above described manganese-aluminum-carbon-nickel alloy. The alloy had a substantially metastable disordered orthorhombic crystal structure and was not magnetic. Each wafer had a mass of approximately 0.1 gram. Eleven (11) of the samples were tempered by means of laser radiation to transform the microstructure to a magnetically coercive microstructure. The other 10 samples were heated in a conventional oven to accomplish the phase transformation.

The samples to be radiated by the laser were polished on one of the flat faces and attached to a glass support tube at the other flat face. A platinum-10% rhodium thermocouple was pressed against the back face of each sample and connected to a temperature recorder. FIG. 1 shows a laser-tempering setup. As seen at FIG. 1, beam 2 generated by laser 4 is focused through lens 6 onto Mn-Al-C-Ni Sample 8. Preferably, for heating an entire sample disc 8, the laser beam 2 is diffused by lens 6 to irradiate substantially all of the sample surface 9. The glass rod 10, disc 8 assembly is mounted by means of clamp 14 to ring stand 16 on stage 12 adapted to have vertical and horizontal translational capabilities, as indicated by the arrows.

Because the samples were of finite thicknesses, the temperature measured at the back of the laser-tempered samples, heated on one side only, was not the same as or a direct measure of the temperature at the radiated surface.

TABLE I sets out data for the laser irradiation of the 11 samples. The thermocouple temperature is the temperature measured by the sensor at the back of the sample; the radiation time is the total time the sample was exposed to the laser beam; and M is the magnetization of the sample, measured in an applied magnetic field of 15 kiloOersteds in electromagnetic units (emu) per gram. The magnetism in Oersteds is calculated by multiplying M in emu per gram by the density of the alloy—here 5.1 grams per cubic centimeter; and $H_{ci}$ is the intrinsic magnetic coercivity of the magnetized samples in kiloOersteds at room temperature.

TABLE I

| Laser-Tempered Sample | Thermo-couple Temp. (°C.) | Radi-ation Time (min.) | M (emu/gm) | $H_{ci}$ (Oe) |
|---|---|---|---|---|
| 1 | 270 | 5.0 | 1.1 | 0.0 |
| 2 | 335 | 5.0 | 1.6 | 1.1 |
| 3 | 340 | 5.0 | 4.0 | 1.3 |
| 4 | 395 | 5.0 | 3.3 | 1.2 |
| 5 | 440 | 5.0 | 39.0 | 1.3 |
| 6 | 440 | 5.0 | 84.8 | 0.7 |
| 7 | 485 | 5.0 | 62.4 | 1.2 |
| 8 | 500 | 5.0 | 82.1 | 0.7 |
| 9 | 500 | 20.0 | 81.4 | 0.7 |
| 10 | 520 | 0.3 | 81.0 | 0.9 |
| 11 | 540 | 5.0 | 85.0 | 1.0 |
| | | | | $\overline{H}_{ci}$1.01 |

TABLE II presents the same data for 10 like alloy samples heated in an oven for the time indicated to accomplish the nonmagnetic-to-magnetic phase transformation.

TABLE II

| Oven-Tempered Sample | Annealing Temp. (°C.) | Oven Time (min.) | M (emu/gm) | $H_{ci}$ (Oe) |
|---|---|---|---|---|
| 1 | 440 | 5.0 | 1.1 | 0.0 |
| 2 | 500 | 5.0 | 7.1 | 1.4 |
| 3 | 500 | 20.0 | 34.6 | 1.2 |
| 4 | 500 | 0.3 | 1.7 | 1.2 |
| 5 | 530 | 5.0 | 37.0 | 1.2 |
| 6 | 530 | 20.0 | 77.7 | 1.2 |
| 7 | 550 | 10.0 | 78.3 | 1.2 |
| 8 | 550 | 20.0 | 78.2 | 1.2 |
| 9 | 580 | 5.0 | 78.1 | 1.2 |
| 10 | 580 | 20.0 | 78.0 | 1.1 |
| | | | | $\overline{H}_{ci}$1.2 |

It can be seen from the TABLES that significant magnetization, i.e., magnetization greater than about 2.0 emu per gram, was achieved at a temperature of approximately 440° C. for the laser-treated samples and at about 500° C. for the oven-tempered samples. We believe that the disparity of the two values is due to the temperatures gradient experienced by the laser-tempered samples. The samples tempered in the oven received heating equally from all sides, while those tempered by the laser were heated on one side only.

The threshold temperature for magnetic coercivity was about 340° C. for the laser-tempered samples and above about 500° C. for the oven-tempered samples. Coercivity occurs abruptly at a critical temperature but does not change substantially with higher treating temperatures. We believe that the difference of approximately 160° C. between the laser coercivity ($H_{ci}$) threshold (approximately 340° C.) and the oven coercivity threshold (approximately 500° C.) depends to some extent on the tempering method-the laser tempering threshold being substantially lower and thus preferred.

Figure 2:
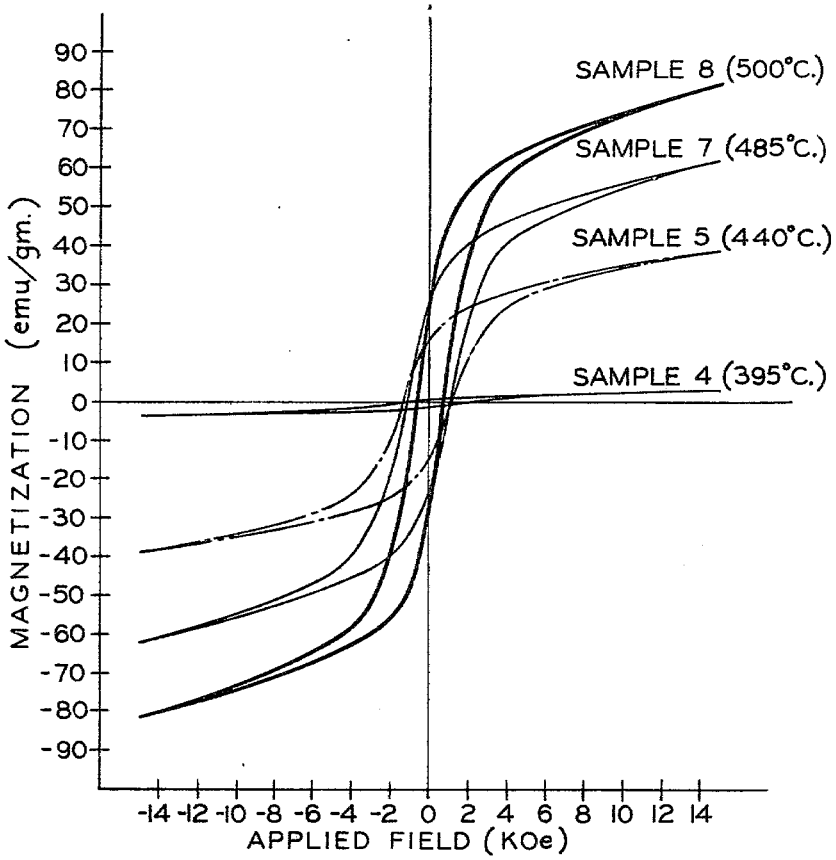
FIG. 2 is a hysteresis curve of magnetization versus applied field for laser-tempered manganese-aluminum alloy samples.

FIG. 2 presents hysteresis curves for four of the correspondingly numbered laser-treated samples of TABLE I. The pronounced S-shape of the curves stems from the room temperature coercivity of each sample—generally about 1 kiloOersted. The curves indicate a general increase in permanent magnetization with tempering temperature above the threshold (about 340° C.).

EXAMPLE 2

A flat slab, about 12 mm in diameter and 0.1 mm thick, was cut from an ingot of nonmagnetic Mn-Al-Ni-C material. The face to be radiated was polished and the slab was mounted on a glass rod and positioned on the translation stage, generally as shown at FIG. 1. The letters "GM" were roughly traced on the face of the sample with a 3-watt beam from an $Ar^+$ laser with a beam spot diameter of about 30 microns. The laser trace speed was manually controlled by adjusting the translation table. The beam spot was moved as melting of the irradiated surface region became evident. The melted material was later polished from the surface so that the alloy beneath, which had been heated to a temperature in the transformation range (above about 500° C., but below the melting temperature), was exposed. The sample was then exposed to a 15 kiloOersted-applied magnetic field. Only the magnetically written "GM" trace was magnetized, the remainder of the matrix being nonmagnetic in nature. Magnetic nickel power was sprinkled over the surface of the sample. The portion of the sample irradiated by the laser clearly attracted the nickel powder in the "GM" pattern.

EXAMPLE 3

Another disc-shaped sample, about 10 mm in diameter and 0.1 mm thick, was prepared as in above Example 2. The face to be radiated was polished, mounted on a glass rod, and positioned in an apparatus like that shown at FIG. 1. A laser beam spot about 30 microns in diameter was traced along the surface in a series of straight strokes at a rate such that some melting was observed at the sample surface. The surface was polished to remove any material heated above the transformation temperature. The sample was then exposed to a 15 kiloOersted-applied magnetic field, the stripes written by the laser trace being selectively magnetized. Application of magnetic nickel powder to the disc surface confirmed that the stripes were magnetic. An electron-micrograph of the sample revealed the selectively magnetized region as stripes having relatively darker shading than the nonmagnetic background. The sample was demagnetized and another micrograph was taken. The selectively tempered region could not be distinguished from the rest of the matrix. Thus, we believe that the field associated with the permanently magnetized region perturbs the electron optics of the microscope, making these regions appear darker on a micrograph.

Figure 3:
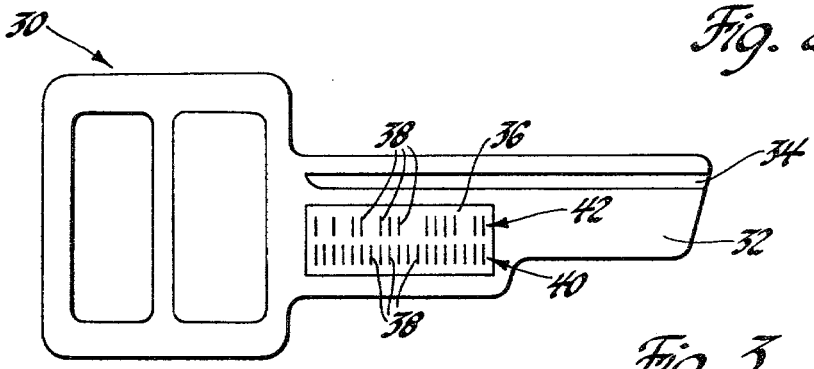
FIG. 3 illustrates an automotive vehicle ignition key provided with a manganese-aluminum insert in accordance with the invention. The insert has been coded as desired with an array of spaced lines, the lines being magnetic while the insert itself is nonmagnetic.

FIG. 3 shows an ignition key 30 for an automotive vehicle. The key may be made of any suitable material. The shank portion 32 is provided with a groove 34 to guide it into a lock bolt (not shown). Key 30 is further provided with an insert 36, preferably of a nonmagnetic alloy of aluminum and 65–75 weight percent manganese. The insert 36 has been selectively tempered in accordance with the invention to form a permanently magnetized portion, shown as lines 38 in FIG. 3. Lines 38 of row 40 may serve as reference lines for row 42. The lines are detectable by, e.g., a magnetic tape head of the type used to play magnetic recording tapes. The spacing and number of lines in row 42, compared with reference row 40, provides a unique code for key 30. The ignition lock is released when the key code matches the preprogrammed lock code. Just a few lines can provide thousands of code combinations. Moreover, the key code is invisible to the eye and not susceptible to demagnetization during normal use.

By our invention herein disclosed, we have provided the first known and method of magnetizing a selected, well-defined portion of a nonmagnetic metal matrix for many useful purposes.

While our invention has been described and illustrated in terms of specific embodiments thereof, it is understood that other forms and/or modifications may be readily adapted by one skilled in the art. Our invention therefore is limited only by the following claims.

The embodiments of the invention in which an exclusive property or privilege is claimed are defined as follows:

1. A nonmagnetic body formed of a manganese-aluminum based alloy comprising about 65–75 weight percent manganese and carrying magnetically readable information in the form of one or more integral regions of high magnetic coercivity.

2. A nonmagnetic body formed of a manganese-aluminum based alloy comprising about 65–75 weight percent manganese and having a substantially orthohombic crystal structure, said body carrying magnetically readable information in the form of one or more integral regions of high magnetic coercivity having a substantially different crystal microstructure.

3. An article formed of a manganese-aluminum based alloy comprising about 65–75 weight percent manganese and having a first portion that is nonmagnetic and a second portion integral therewith having high magnetic coercivity.

4. An article formed of a manganese-aluminum based alloy comprising about 65–75 weight percent manganese in a nonmagnetic state having portions thereof heated in situ and converted to a state that is magnetically coercive.

5. A method of forming a body of a manganese-aluminum based alloy treated to record information in magnetically readable form, said method comprising:

heat-treating said alloy body to place it entirely in a nonmagnetic condition; and thereafter recording said information on said body in the form of one or more predetermined ferromagnetic regions by selectively tempering said body in said regions to convert the crystal structure in said regions to a ferromagnetic form.

6. A method of forming a unitary body of a manganese-aluminum based alloy having a ferromagnetic portion and a nonmagnetic portion, said method comprising:

providing an alloy body in an entirely nonmagnetic condition, and selectively tempering the portion of said body to be made ferromagnetic to alter its crystal structure.

7. A method of forming an integral body of a manganese-aluminum based alloy having a portion that is nonmagnetic and a portion thereof that is magnetically coercive, said method comprising:

quenching a body of said alloy from a temperature above about 1100° C. to below about 400° C., to place said body entirely in a nonmagnetic condition, and thereafter selectively tempering a portion of said body to alter its crystal structure to a magnetically coercive form.

8. A method of forming a body of a manganese-aluminum based alloy that undergoes a heat induced phase transformation from a first crystal structure that is nonmagnetic to a second crystal structure that is magnetically coercive, the method comprising;

heat treating said body to place it entirely in said first nonmagnetic crystal structure; and thereafter recording information on said body in the form of one or more predetermined ferromagnetic regions by selectively tempering said body in said regions to convert the crystal structure from said first nonmagnetic structure to said second magnetically coercive structure.

* * * * *